United States Patent [19]

Santo

[11] 3,949,273

[45] Apr. 6, 1976

[54] BURNER IGNITION SYSTEM

[75] Inventor: Eugenio Espiritu Santo, Rockford, Ill.

[73] Assignee: Sundstrand Corporation, Rockford, Ill.

[22] Filed: June 20, 1974

[21] Appl. No.: 481,351

[52] U.S. Cl. ..... 317/96; 431/264

[51] Int. Cl.[2] ..... F23Q 3/00

[58] Field of Search ..... 315/209 SC; 317/96; 431/71, 254, 255, 264, 265

[56] References Cited

UNITED STATES PATENTS

| | | | |
|---|---|---|---|
| 3,369,151 | 2/1968 | Minks | 315/209 SC |
| 3,510,725 | 5/1970 | Tyler | 317/96 X |
| 3,556,706 | 1/1971 | Campbell | 317/96 X |
| 3,681,001 | 8/1972 | Potts | 317/96 X |
| 3,710,192 | 1/1973 | Budlane | 431/264 X |
| 3,849,670 | 11/1974 | Lourigan | 431/265 X |

*Primary Examiner*—Joseph V. Truhe
*Assistant Examiner*—Clifford C. Shaw
*Attorney, Agent, or Firm*—Wegner, Stellman, McCord, Wiles & Wood

[57] ABSTRACT

A burner ignition circuit produces high frequency sparks between a pair of spaced electrodes connected to opposite sides of a secondary winding of a transformer in response to the repetitive discharge of a capacitor through the primary winding under the control of an SCR powered by a full wave rectifier such that sparks are produced throughout both half waves of AC power. The discharge capacitor is primarily charged from the power supply through a current limiting resistor. The turn-on time of the SCR is minimized by a trigger circuit including a diac which discharges another capacitor into the gate of the SCR when the voltage thereacross exceeds a selected value. Circuitry including a diode connected between the capacitor and the primary winding is provided to prevent LC oscillation between the discharge capacitor and the primary winding of undesirable residual energy stored in the inductance of the primary winding immediately following each turn-off of the SCR. In one embodiment, the diode is connected to the capacitor through the current limiting resistor and this undesirable oscillating energy is used to provide a further source of charging current for the discharge capacitor. In another embodiment, a diode and resistor are connected in a closed loop with the primary winding, and the residual energy is dissipated by the resistor.

4 Claims, 2 Drawing Figures

46
48
+
66
24
64
50
58
22
54
14
60
56
34
28
26
120v
A.C.
10
38
40
32
30
36
12
44
42
20
52
62
18
17
19
21
16
23
-

46
+
48
70
50
42
12
22
54
14
34
28
26
120v
A.C.
10
38
56
62
20
32
30
52
72
76
80
18
17
21
74
78
16
23
-

BURNER IGNITION SYSTEM

BACKGROUND OF THE INVENTION

The present invention relates to burner ignition circuits for producing electrical sparks to ignite the fuel of a fuel oil burner or the like and, more particularly, to such circuits which produce ignition sparks at a frequency substantially in excess of the AC power supply therefor.

As discussed in U.S. Pat. No. 3,556,706, conventional fuel oil burners or the like include a nozzle for creating a spray pattern of oil particles in an air stream produced by a blower, which have been traditionally ignited as they emerge from the nozzle by sparks created between a pair of spark electrodes located upstream in the air stream from the spray pattern powered by high voltage step-up transformers coupled to an AC supply. More recently, electronic ignition circuits, such as the one shown in U.S. Pat. No. 3,556,706, have been provided which produce the requisite high frequency ignition sparks comparable to those produced by the aforementioned high voltage step-up transformers, but are smaller in size, lighter in weight, less expensive and more efficient than the conventional spark transformers.

While it may be suggested that the ignition systems such as the one in the aforementioned patent function in a more or less satisfactory manner, certain apparent disadvantages exist in such circuits. For example, although an AC power supply is utilized, the circuit is operative to produce high frequency sparking only during the positive half waves of the power supply. In addition, the SCR switch used to discharge the capacitor is slowly turned on by a long transition trigger signal developed by an RC circuit. The relatively long turn-on time of the SCR results in an output signal having a magnitude less than that which would otherwise be produced.

A further problem encountered in circuits such as the one shown in the aforementioned patent is that at the end of each discharge cycle, oscillating residual energy stored in the LC circuit formed by the primary winding and the capacitor may result in development of a reverse polarity charge on the capacitor that must be overcome during the next charging cycle. Further, the undesirable oscillating residual energy may result in partial cancellation of the next discharge current signal through the primary winding. An attempted solution to this problem has included the provision of a feedback circuit including a diode connected between the primary winding and the discharge capacitor to return this undesired residual energy back to the capacitor to charge it in the desired polarity direction. However, because of the manner in which such circuits have been connected back to the capacitor, LC filter circuits using expensive circuit elements have had to be included in the feedback network.

SUMMARY OF THE INVENTION

The foregoing disadvantages of prior burner ignition circuits are substantially eliminated in the burner ignition circuits of the present invention in a unique and novel manner. Briefly, a full wave rectifier connectible with an AC source of power is utilized to permit operation of the circuit to produce ignition sparking throughout each full wave of AC. Further, a trigger circuit for the SCR is provided with a diac which discharges a capacitor into the gate of the SCR to minimize its turn-on time, thereby maximizing the resultant output magnitude. Another important feature of the present invention is the provision of unique feedback circuitry connected between the primary winding and the discharge capacitor to remove the undesired, residual oscillating energy developed each time the SCR is turned off which, if not removed, would decrease the efficiency of the circuit by requiring a greater amount of power to charge the capacitor during the successive cycle and by partially cancelling successive discharge current spikes through the primary winding. In addition to improving efficiency, the feedback circuit operates to render nonlinear the relationship between the power supply voltage and the capacitor voltage to permit effective operation at low power supply voltages and safe operation at high power supply voltages.

In one embodiment of the ignition control system of the present invention, the feedback circuit comprises a diode connected between the primary winding and the capacitor through the current limiting resistor through which the capacitor is charged from the power supply. In that embodiment, the feedback circuit not only removes the reverse polarity charge, but also provides another source of charging circuit for the capacitor. Because the diode is connected to the capacitor through the current limiting resistor, a filter or phase delay circuit need not be provided in the feedback network.

In another embodiment, the reverse polarity charge on the discharge capacitor is removed by a circuit including a diode and series resistor connected between the negative plate of the capacitor and the primary winding, forming a closed loop with the primary winding. During each successive half cycle of the LC oscillation, the resistor dissipates some of the undesirable residual energy, thereby damping out the oscillations.

BRIEF DESCRIPTION OF THE DRAWINGS

The foregoing features and advantages of the burner ignition system of the present invention will be made more apparent and further features and advantages will be disclosed in the following description of the preferred embodiments thereof, taken in conjunction with the following drawing in which.

DESCRIPTION OF THE PREFERRED EMBODIMENTS

Figure 1:
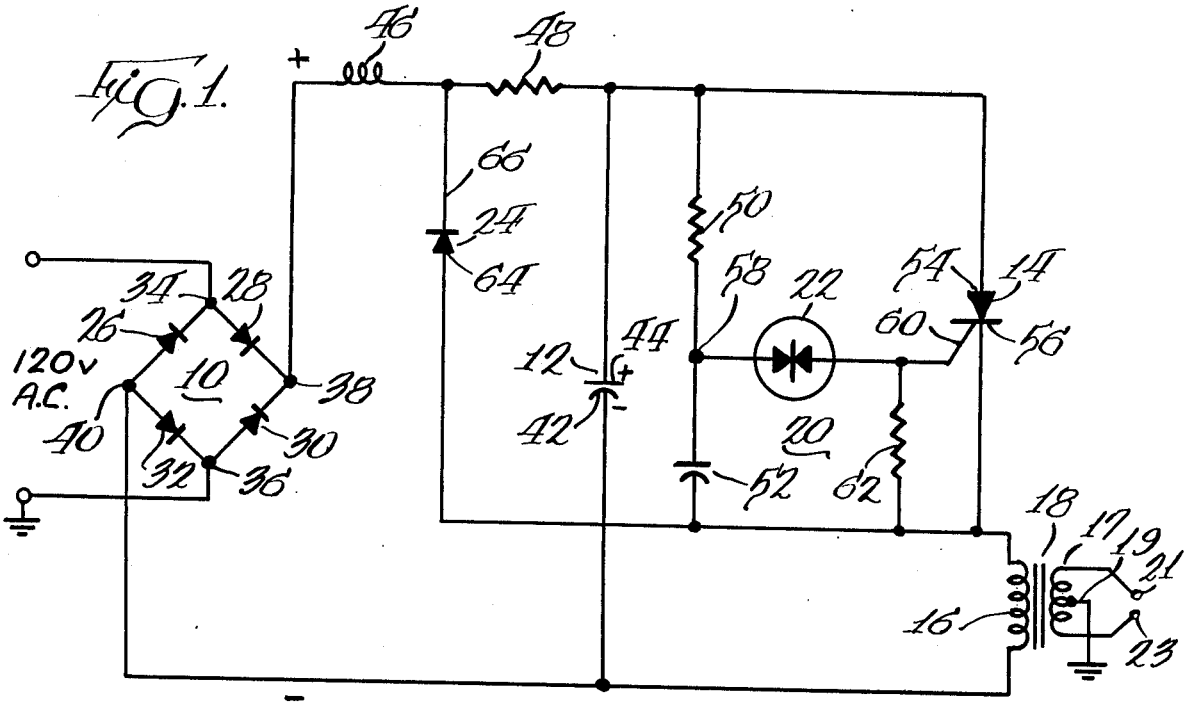
FIG. 1 is a schematic diagram of a preferred embodiment of the burner ignition circuit of the present invention in which the deleterious effects of the residual stored energy are eliminated by utilizing that energy to charge the capacitor with a voltage of the desired polarity.

Turning to FIG. 1 of the drawings, a preferred embodiment of a burner ignition circuit constructed in accordance with the present invention is seen to include a source of DC power, generally designated by reference numeral 10, to provide a first source of charging current to a discharge capacitor 12, a controllable switch, such as SCR 14, for discharging capacitor 12 through the primary winding 16 of a spark transformer 18, a trigger circuit generally designated by reference numeral 20, including a voltage breakdown device, such as diac 22, for turning on SCR 14 at appropriate times, and, finally, a circuit including a unidirectional conducting device, such as diode 24, to provide a second source of charging current for the capacitor from the residual energy found in the LC circuit of capacitor 12 and primary winding 16.

The purpose of the circuit is to produce fuel ignition sparks. Transformer 18 comprises a step-up transformer, and each time capacitor 12 is discharged through the primary winding 16, a high voltage pulse is induced in a secondary winding 17 conductively coupled therewith. For safety reasons, secondary winding 17 has a center tap 19 connected to ground to reduce the maximum voltage with respect to ground by one-half. A pair of spaced electrodes 21 and 23 are respectively coupled to opposite sides of secondary winding 17, and each time a high voltage pulse is developed therein, an electrical spark is produced therebetween to ignite the fuel.

In most applications, the burner ignition circuit will ultimately be powered by an AC source such as the standard 120-volt 60 hertz AC power commonly referred to as household current or power. It has been discovered that the efficiency and thoroughness of fuel ignition by electrical sparking is improved if ignition sparks are produced throughout each full wave cycle of the AC rather than only during alternate half waves. Accordingly, the source of DC power 10 comprises a full wave rectifier having four diodes, diode 26, 28, 30 and 32, connected in a bridge configuration to form a full wave rectifier. When an AC voltage is applied across input terminals 34 and 36 of the full wave rectifier, a full wave, unregulated, but substantially continuous, source of DC power is provided across output terminals 38 and 40 with the DC voltage at output terminal 38 being positive with respect to the voltage at terminal 40.

The power supply 10 provides a first source of charging current for capacitor 12. The negative power supply terminal 40 is directly connected to a negative plate 42 of capacitor 12, and the positive plate 44 of capacitor 12 is connected to the positive power supply terminal 38 through an inductor or choke 46 and a current limiting resistor 48. Current limiting resistor 48 functions to establish the rate at which the discharge capacitor 42 is charged, and provides a resistive impedance through which a feedback circuit can be connected to the discharge capacitor, as will be explained in more detail hereinafter. Choke 46 provides a supplemental source of charging current to discharge capacitor 12 immediately after turn-off of the SCR. Prior to turn-off of the SCR, choke 46 acts as a current limiter to prevent the SCR 14 from being provided with current by the power supply which would hinder turn-off of the SCR 14 at the end of discharge of capacitor 12.

Rapid turn-on of the SCR 14, after the discharge capacitor 12 has been charged to a suitable level, is ensured by trigger circuit 20. A series circuit of a resistor 50 and a trigger capacitor 52 is connected across SCR 14 with a junction 58 therebetween connected to a control input or gate 60 of SCR 14 through diac 22. The side of resistor 50, connected to the anode 54 of SCR 14 is connected to the junction between charging circuit resistor 48 and discharge capacitor 12, and the side of capacitor 52, connected to the cathode 56 of the SCR 14, is connected to one side of primary winding 16. A resistor 62, connected between gate 60 and cathode 56, functions as a clamp to improve turn-on noise immunity of SCR 14. It has also been observed that resistor 62 improved the gate turn-on and turn-off characteristics of SCR 14.

When the voltage across capacitor 52 exceeds a preselected value corresponding to the voltage breakdown level of diac 22, SCR 14 is triggered into conduction to discharge capacitor 12 through primary winding 16. Inductor 46 and resistor 48, in addition to providing a charging circuit for discharge capacitor 12, conduct charging current to capacitor 52 through resistor 50. The rate at which capacitor 52 charges is of course dependent upon the values of inductor 46, resistor 48, resistor 50 and primary winding 16, but can be primarily established by selecting an appropriate value for resistor 50. In either event, the respective values of these elements must be selected such that capacitor 52 exceeds the breakdown voltage of diac 22 only after the charge on capacitor 12 has reached a suitable level to be discharged. Diac 22 is normally in a nonconductive state to permit capacitor 52 to be charged but when the charge across capacitor 52 exceeds the breakdown voltage of diac 22, it switches to a conductive state and discharges capacitor 52 therethrough into gate 60 of SCR 14. This discharge current spike applied to gate 60 causes SCR to rapidly switch to its conductive state to discharge capacitor 12 through primary winding 16.

SCR 14, once turned on, remains in its conductive state until the current therethrough decreases below a characteristic maintenance level. After capacitor 12 has been substantially completely discharged, the current through SCR 14 is reduced below this maintenance level, and the SCR 14 reverts to its nonconductive state to again permit discharge capacitor 12 to be charged for the next cycle of operation. Choke 46, which immediately after discharge acts as though it were an open circuit, isolates the power supply from the SCR to permit the current therethrough to be reduced below the maintenance level to effect turn-off.

Because of the inductance of primary winding 16, energy is stored therein during the discharge cycle. Because of this stored energy, primary winding 16 functions as a current source which will cause discharge capacitor 12 to develop a reverse polarity or negative charge. In effect, primary winding 16 and capacitor 12 form an LC resonant circuit. More specifically, primary winding 16 provides charging current into the negative plate 42 of discharge capacitor 12 which causes the negative plate 42 to become positive with respect to positive plate 44. If this condition were permitted to exist, the efficiency of the circuit is substantially reduced. First, if the reverse polarity charge were permitted to remain on the capacitor at the beginning of the next charging cycle, additional charging current from the power supply would have to be provided to overcome the reverse polarity charge to charge the capacitor to the requisite level in the positive polarity direction. In addition, depending upon the resonant frequency of the LC circuit formed by discharge capacitor 12 upon primary winding 16 compared to the frequency of operation of the ignition circuit, energy may be stored in the primary winding 16 at the beginning of the next discharge cycle which would result in a partial cancellation of the discharge current.

In accordance with the present invention, these deleterious effects of LC resonance between capacitor 12 and primary winding 16 are substantially eliminated by the addition of a diode 24 connected through current limiting resistor 48 between the primary winding 16 and the capacitor 12 to remove the residual energy from the LC circuit. As seen in FIG. 1, diode 24 has its anode 64 connected to the junction between primary winding 16 and SCR 14, and its cathode 66 connected to the positive plate 44 of discharge capacitor 12 through resistor 48. In effect, the energy stored in the LC circuit is fed back to the positive plate 44 of discharge capacitor 12 by diode 24 to provide an additional source of charging current. After turn-off of the SCR, the junction between SCR 14 and primary winding 16 develops a voltage positive in polarity with respect to the cathode 66 of diode 24. When this occurs, diode 24 is rendered conductive and current is drawn out of the negative plate 42 of discharge capacitor 12, thereby removing the negative or reverse polarity charge and through primary winding 16, diode 24 and resistor 48 to the positive plate 44 of the discharge capacitor 12.

Thus, not only is the negative polarity charge removed, but an additional positive polarity charge of the capacitor is provided, such that after being charged by the power supply through inductor 46 and resistor 48, a voltage is developed across discharge capacitor 12 which is in excess of the peak voltage of the DC power supply appearing across output terminals 38 and 40.

Figure 2:
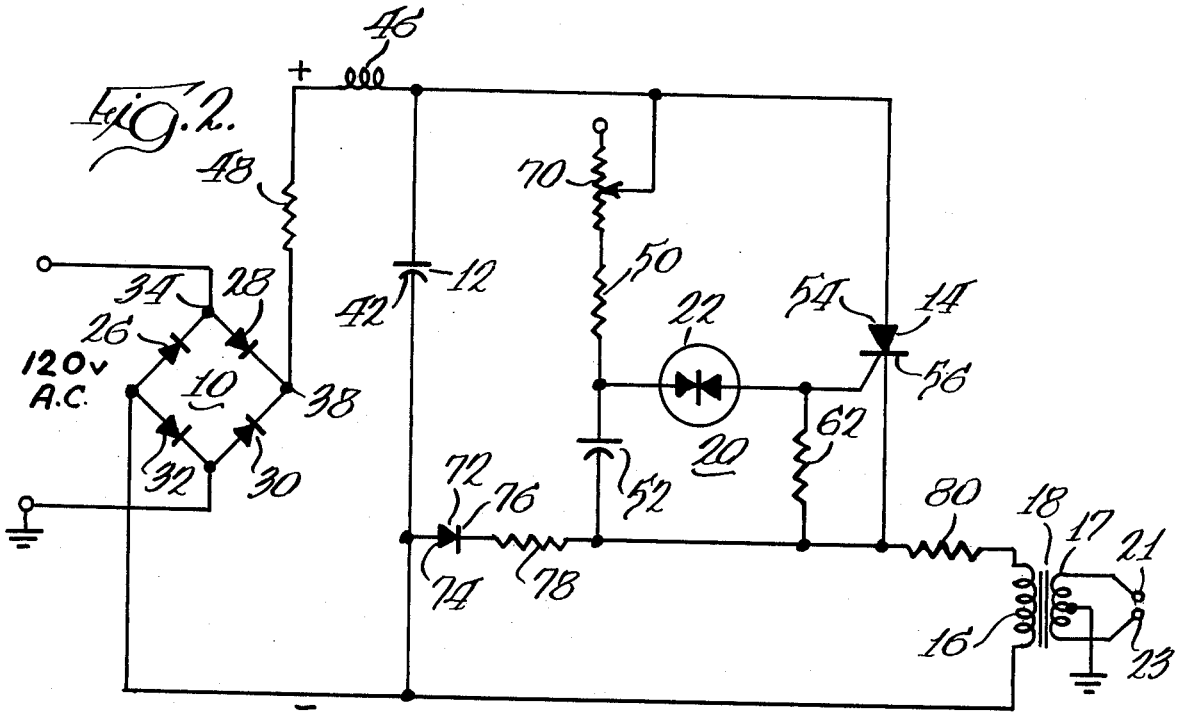
FIG. 2 is a schematic diagram of another embodiment of the burner ignition circuit of the present invention in which the residual energy is dissipated through resistors.

Turning now to FIG. 2 of the drawings, another embodiment of the burner ignition circuit is shown in which the residual energy is dissipated through resistors. The embodiment of FIG. 2 is similar to that of FIG. 1, and accordingly, elements in the circuit of FIG. 2 corresponding in function and operation to like elements in the circuit of FIG. 1 are given the same reference numerals. Briefly, power supply 10, including resistor 48 and inductor 46, are provided to charge the discharge capacitor 12 in a fashion identical to that in the circuit of FIG. 1. Further, the trigger circuit 20 operates in the identical fashion as the trigger circuit of FIG. 1 with the exception that an additional variable resistor 70 connected in series between resistor 50 and the positive plate 44 of the discharge capacitor 12 may be provided to selectively vary the charge rate of the trigger circuit capacitor 52 and thus to selectively vary the peak magnitude developed across the discharge capacitor 12. Likewise, similarly, the SCR 14 and transformer 18 and associated circuitry perform the same function in FIG. 2 as in the circuit of FIG. 1.

The principal difference between the two embodiments resides in the operations performed to remove the undesirable effects of the residual energy stored in the primary winding. In the circuit of FIG. 2, the diode 24 of the circuit of FIG. 1 has been removed, and in lieu thereof a diode 72 has been added connected between the negative plate 42 of discharge capacitor 12 and the primary winding 16 of transformer 18. More specifically, the anode 74 of diode 72 is connected to the negative plate 42, and the cathode 76 is connected to the primary winding 16 through a resistor 78, connected between cathode 76 and the negative plate of trigger circuit capacitor 52, and a resistor 80 connected between the cathode 56 of SCR 14 and primary winding 16. As performed by diode 24 in the circuit of FIG. 1, the circuitry, including diode 72, resistor 78 and resistor 80, functions to remove the reverse polarity charge from the capacitor and to eliminate, or at least substantially alleviate, the partial spark cancellation effect of residual energy stored in primary winding 16. This is achieved by dissipating the residual energy through resistors 78 and 80.

Initially, after turn-off of SCR 14, which occurs when capacitor 12 has been substantially discharged and the current through SCR 14 has fallen below the necessary maintenance level, the residual energy stored in primary winding 16 is transferred to capacitor 12, producing a reverse polarity or negative voltage thereacross. Specifically, capacitor 12 develops a potential on its negative plate 42 which is positive with respect to its positive plate 44. Diode 72, which during the charging portion of the cycle, when capacitor 12 is charged in the positive direction, becomes forward-biased when this negative charge is developed across capacitor 12. Upon becoming forward-biased, diode 72 then conducts current out of the negative plate of capacitor 12 through resistors 78 and 80 to primary winding 16. Resistors 78 and 80 dissipate a substantial portion of the residual energy. The same result occurs during the next cycle of LC resonance, and more energy is dissipated. Thus, in effect, diode 76 and resistors 78 and 80 function as a damping circuit to damp out the voltage oscillations produced in the primary winding so that they will not partially cancel the next discharge current pulse, and further remove the negative charge initially produced across the discharge capacitor.

In addition to the above-described features, diode 72 and resistor 78 provide a negative pulse signal or "anti-latchup" signal to the trigger circuit capacitor 52 after SCR 14 has been turned off. Further, resistor 80 of the damping circuit also functions as a discharge control for the high energy discharge pulse to increase its time duration and the rate of energy dissipated by the resultant spark to improve ignition efficiency.

Thus, it is seen that burner ignition circuits are provided in accordance with the present invention which provide high frequency ignition sparking throughout each half wave of an AC power supply therefor with an improved power effiency and ignition efficiency. While the particular frequency of operation is of course dependent upon the particular application to which the circuit is put, it has been found that a frequency of operation of approximately 3,000 to 5,000 sparks per second is suitable for most purposes.

The particular frequency of operation that does result is of cource dependent upon the particular values of the various circuit elements. Circuits built in accordance with the schematics shown in FIGS. 1 and 2 have been found to operate in a suitable manner when constructed with identified circuit elements of the following trade designations and values:

FIG. 1

| Reference No. | Description | Value | Trade Designation |
|---|---|---|---|
| 12 | Capacitor | .47 microfarad | — |
| 14 | SCR | — | C107C |
| 18 | Transformer | | |
| | Primary winding inductance | 285 microhenry | — |

-continued

FIG. 1

| Reference No. | Description | Value | Trade Designation |
|---|---|---|---|
| | Transformer ratio | 40 | — |
| 22 | Diac | — | RCA 45412 |
| 24 | Diode | — | 10D4 |
| 26,28,30,32 | Diodes | — | 1N4004 |
| 46 | Choke | 300 microhenry | — |
| 48 | Resistor | 25 ohms | — |
| 50 | Resistor | 18–50 kilohms | — |
| 52 | Capacitor | .047 microfarad | — |
| 62 | Resistor | 27 ohms | — |

FIG. 2

| Reference No. | Description | Value | Trade Designation |
|---|---|---|---|
| 18 | Transformer | | |
| | Primary winding inductance | 60 microhenry | — |
| | Transformer ratio | 48 | — |
| 50 | Resistor | 18 kilohms | — |
| 70 | Variable resistor | 0–50 kilohms | — |
| 78 | Resistor | 100 ohms | — |
| 80 | Resistor | One ohm | — |

The values not given for elements in FIG. 2 which have been given the same reference numerals as those in FIG. 1 are the same as the values given with respect to FIG. 1.

I claim:

1. In a burner ignition circuit having a capacitor and a controlled switch connected therewith for repetitively discharging the capacitor through a primary winding of a transformer to generate electrical sparks between a pair of spaced electrodes respectively connected to opposite sides of a secondary winding of the transformer and in which undesirable residual energy is stored in the LC circuit formed by the inductance of the primary winding and the capacitor at the end of each discharge cycle, an improved charging circuit for the capacitor, comprising:

a source of substantially continuous DC power;

means including a current limiting resistor connected between the source of DC power and the capacitor for conducting charging current from the source of DC power to the capacitor to charge the capacitor in a selected polarity direction; and means for removing the undesirable residual energy from the LC circuit of the primary winding and the discharge capacitor, including a unidirectional conducting device connected between the primary winding and the capacitor through said resistor, said unidirectional conducting device providing additional charging current to the capacitor through the resistor from said undesirable stored residual energy to further charge said capacitor in the desired polarity direction.

2. The charging circuit of claim 1, in which said source of continuous DC power comprises a full wave rectifier circuit connectible with a source of AC power.

3. The charging circuit of claim 1, in which the unidirectional conducting device comprises a diode having an cathode connected with the capacitor through said resistor and an anode directly connected with the primary winding.

4. In a burner ignition circuit having a capacitor and a controlled switch connected therewith for repetitively discharging the capacitor each time it is charged through a primary winding of a transformer to generate electrical sparks between a pair of spaced electrodes respectively connected to opposite sides of a secondary winding of the transformer, and in which residual energy is stored in the LC circuit formed by the inductance of the primary winding and the discharge capacitor at the end of each discharge cycle, an improved charging circuit for the capacitor, comprising:

a source of substantially continuous DC power;

means connected with the source of DC power and one side of the capacitor for conducting substantially continuous DC current therebetween for charging the capacitor in a first polarity direction; and means including a unidirectional conductive device and a resistive means in series therewith connected with the other side of the capacitor and the primary winding conducting current therebetween to dissipate undesirable residual energy stored in the LC circuit formed by the capacitor and the primary winding when the capacitor has a charge thereon of polarity opposite to said first polarity, said dissipating means being disabled from conducting current during the charging of said capacitor by the first polarity charge on said capacitor.

* * * * *